US009120320B2

(12) United States Patent
Yoneta

(10) Patent No.: US 9,120,320 B2
(45) Date of Patent: Sep. 1, 2015

(54) LIQUID EJECTION HEAD AND IMAGE FORMING DEVICE

(71) Applicant: Ryohta Yoneta, Tokyo (JP)

(72) Inventor: Ryohta Yoneta, Tokyo (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/146,078

(22) Filed: Jan. 2, 2014

(65) Prior Publication Data

US 2014/0218450 A1 Aug. 7, 2014

(30) Foreign Application Priority Data

Feb. 6, 2013 (JP) ..... 2013-021841

(51) Int. Cl.
*B41J 2/175* (2006.01)
*B41J 2/14* (2006.01)

(52) U.S. Cl.
CPC ..... *B41J 2/17563* (2013.01); *B41J 2/14274* (2013.01); *B41J 2202/11* (2013.01)

(58) Field of Classification Search
USPC ..... 347/93, 84, 85
See application file for complete search history.

(56) References Cited

U.S. PATENT DOCUMENTS

| | | | | |
|---|---|---|---|---|
| 4,904,394 | A * | 2/1990 | Clarke et al. | 210/739 |
| 5,489,930 | A * | 2/1996 | Anderson | 347/71 |
| 6,086,195 | A * | 7/2000 | Bohorquez et al. | 347/93 |
| 6,669,336 | B1 * | 12/2003 | Kneezel et al. | 347/93 |
| 6,685,299 | B2 | 2/2004 | Hirota | |
| 6,764,605 | B2 * | 7/2004 | Donaldson et al. | 216/39 |
| 7,244,020 | B2 * | 7/2007 | Chikamoto | 347/93 |
| 7,448,741 | B2 * | 11/2008 | von Essen | 347/93 |
| 7,775,652 | B2 * | 8/2010 | Taira et al. | 347/93 |
| 7,901,064 | B2 * | 3/2011 | Urayama et al. | 347/93 |
| 8,172,389 | B2 | 5/2012 | Sugahara | |
| 8,348,407 | B2 | 1/2013 | Matsufuji et al. | |
| 8,714,722 | B2 * | 5/2014 | Hays et al. | 347/93 |
| 2002/0171715 | A1 * | 11/2002 | Takahagi et al. | 347/70 |

(Continued)

FOREIGN PATENT DOCUMENTS

| | | |
|---|---|---|
| JP | 2002-355962 | 12/2002 |
| JP | 2007-190719 | 8/2007 |

(Continued)

OTHER PUBLICATIONS

U.S. Appl. No. 14/020,951, filed Sep. 9, 2013.

(Continued)

*Primary Examiner* — Julian Huffman
*Assistant Examiner* — Leonard S Liang
(74) *Attorney, Agent, or Firm* — Cooper & Dunham LLP

(57) ABSTRACT

A liquid ejection head includes a plurality of nozzles to eject liquid drops; a plurality of individual liquid chambers communicating with the plurality of nozzles; a plurality of liquid inlet portions leading to the plurality of individual liquid chambers; a common liquid chamber to supply liquid to the plurality of individual liquid chambers; and a plurality of filter portions disposed between the common liquid chamber and the liquid inlet portions, each of the filter portions including filter holes and filtering the liquid, wherein a plurality of reinforcement parts are provided to partition the plurality of filter portions, each of the reinforcement parts includes a part facing some of the filter holes of a corresponding one of the plurality of filter portions in a liquid flow direction, with a gap between the filter holes and the reinforcement part.

6 Claims, 10 Drawing Sheets

(56) References Cited

U.S. PATENT DOCUMENTS

| | | | | |
|---|---|---|---|---|
| 2005/0117005 | A1* | 6/2005 | Fujii et al. | 347/92 |
| 2007/0176990 | A1* | 8/2007 | Urayama et al. | 347/93 |
| 2009/0309933 | A1* | 12/2009 | Shibata et al. | 347/63 |
| 2010/0328409 | A1* | 12/2010 | Matsufuji et al. | 347/93 |
| 2013/0242012 | A1* | 9/2013 | Hayashi et al. | 347/93 |
| 2013/0307911 | A1* | 11/2013 | Hayashi | 347/93 |

FOREIGN PATENT DOCUMENTS

| | | |
|---|---|---|
| JP | 2008-183800 | 8/2008 |
| JP | 2011-025663 | 2/2011 |
| JP | 2012-179813 | 9/2012 |

OTHER PUBLICATIONS

U.S. Appl. No. 13/788,842, filed Mar. 7, 2013.

* cited by examiner

LIQUID EJECTION HEAD AND IMAGE FORMING DEVICE

BACKGROUND OF THE INVENTION

1. Field of the Invention

The present specification relates to a liquid ejection head and an image forming device including a liquid ejection head.

2. Description of the Related Art

Among image forming devices, such as printers, facsimile machines, copiers, plotters, and multi-functional peripherals, an ink-jet recording device is known as an image forming device of a liquid ejection recording system using a recording head including a liquid ejection head to eject liquid drops.

In such a liquid ejection head, if foreign matter is mixed with a liquid, poor liquid ejection may occur. To prevent the problem, a filter is disposed in a liquid channel in the liquid ejection head to filter the liquid flowing through the liquid channel.

Conventionally, a liquid ejection head provided with a filter portion is known. In this liquid ejection head, the filter portion is disposed between liquid inlet portions and a common liquid chamber, the liquid inlet portions leading to individual liquid chambers communicating with nozzles. The filter portion filters the liquid throughout a whole region of the plurality of individual liquid chambers in a nozzle array direction of the nozzles. The filter portion includes reinforcement ribs which are formed at intervals of a length corresponding to two or more liquid chambers in the nozzle array direction. The filter portion is divided by the reinforcement ribs into plural filter sections, and plural partition walls corresponding to the reinforcement ribs are formed. For example, see Japanese Laid-Open Patent Publication No. 2011-025663.

In the liquid ejection head disclosed in Japanese Laid-Open Patent Publication No. 2011-025663, a width of each of the partition walls in the nozzle array direction is less than a width of each of the reinforcement ribs in the nozzle array direction. Hence, stagnation of liquid may occur on the liquid inlet portion side of the filter portion, and a difficulty of discharging bubbles may occur.

SUMMARY OF THE INVENTION

In an embodiment which solves or reduces one or more of the above-described problems, the present disclosure provides a liquid ejection head including a plurality of nozzles to eject liquid drops; a plurality of individual liquid chambers communicating with the plurality of nozzles; a plurality of liquid inlet portions leading to the plurality of individual liquid chambers; a common liquid chamber to supply liquid to the plurality of individual liquid chambers; and a plurality of filter portions disposed between the common liquid chamber and the liquid inlet portions, each of the plurality of filter portions including filter holes and filtering the liquid, wherein a plurality of reinforcement parts are provided to partition the plurality of filter portions and each of the plurality of reinforcement parts includes a part facing some of the filter holes of a corresponding one of the plurality of filter portions in a liquid flow direction, with a gap between the filter holes and the reinforcement part.

Other objects, features and advantages of the present disclosure will become more apparent from the following detailed description when read in conjunction with the accompanying drawings.

DETAILED DESCRIPTION OF EXEMPLARY EMBODIMENTS

In the following, a description will be given of exemplary embodiments of the present disclosure with reference to the accompanying drawings.

Figure 1:
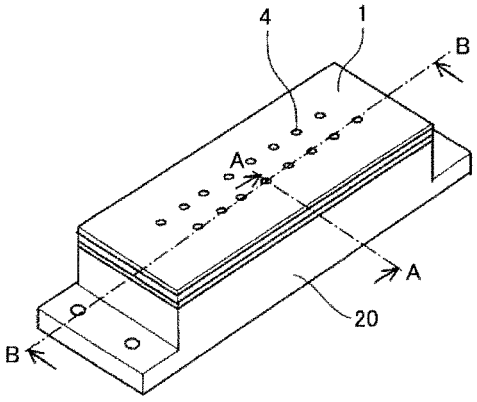
FIG. 1 is a perspective view showing a liquid ejection head according to a first exemplary embodiment.
Figure 2:
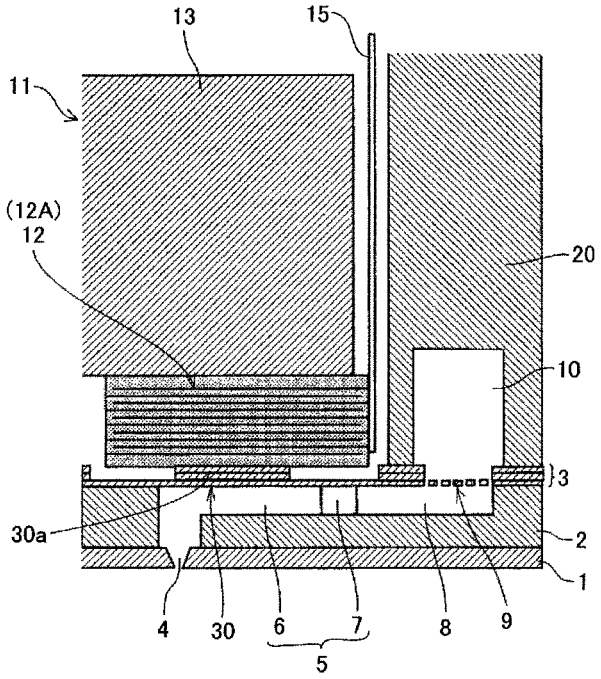
FIG. 2 is a cross-sectional view showing a portion of the liquid ejection head taken along an A-A line indicated in FIG. 1.
Figure 3:
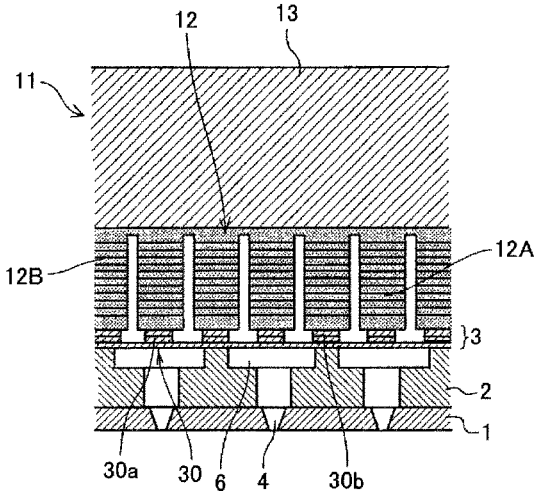
FIG. 3 is a cross-sectional view showing a portion of the liquid ejection head taken along a B-B line indicated in FIG. 1.

A liquid ejection head according to a first exemplary embodiment will be described with reference to FIGS. 1 to 4B. FIG. 1 is a perspective view showing the liquid ejection head according to the first exemplary embodiment. FIG. 2 is a cross-sectional view showing a portion of the liquid ejection head taken along an A-A line indicated in FIG. 1. A direction of the A-A line (which is a longitudinal direction of each of liquid chambers) is perpendicular to a nozzle array direction in which nozzles are arrayed in the liquid ejection head. FIG. 3 is a cross-sectional view showing a portion of the liquid ejection head taken along a B-B line indicated in FIG. 1. A direction of the B-B line (which is a lateral direction of each of the liquid chambers) is parallel to the nozzle array direction in which the nozzles are arrayed in the liquid ejection head.

The liquid ejection head includes a nozzle plate 1, a channel plate 2 (liquid chamber board) 2, and a diaphragm member 3 as a thin film member, which are bonded together to form a laminated structure. The liquid ejection head further includes a piezoelectric actuator 11 to displace the diaphragm member 3, and a frame member 20 as a common channel member. A plurality of individual liquid chambers (pressure chambers) 6, a plurality of liquid supply portions (resistance portions) 7, and a plurality of liquid inlet portions 8 are formed in the nozzle plate 1, the channel plate 2, and the diaphragm member 3. The plurality of individual liquid chambers 6 serving as the pressure chambers is formed to communicate with a plurality of nozzles 4 formed in the nozzle plate 1 from which ink drops are ejected. The plurality of liquid supply portions 7 serving as the resistance portions is formed to supply ink to the individual liquid chambers 6. The plurality of liquid supply portions 7 is formed to lead to the plurality of liquid inlet portions 8.

In this exemplary embodiment, a plurality of individual channels 5 is formed to include the plurality of individual liquid chambers (pressure chambers) 6 and the plurality of liquid supply portions (resistance portions) 7. Alternatively, when the plurality of liquid supply portions (resistance portions) 7 is not formed and the plurality of individual liquid chambers (pressure chambers) 6 is formed to lead to the plurality of liquid inlet portions 8, the individual liquid chambers 6 may serve as the individual channels.

A common liquid chamber 10 as a common channel is formed in the frame member 20. From the common liquid chamber 10, ink is supplied to the individual liquid chambers 6 via filter portions 9 (which are formed in the diaphragm member 3 and described below), the liquid inlet portions 8, and the liquid supply portions 7.

The nozzle plate 1 may be formed by, for example, electroformation (electroforming) of a metal plate of Ni or another metal such as stainless, or formed of a resin film of a resin such as polyimide resin, or formed of a laminated member including a metal layer and a resin layer in combination. The nozzle plate 1 includes the plurality of nozzles 4 each having a diameter of, for example, approximately 10 to 35 μm, corresponding to the respective liquid chambers 6. The nozzle plate 1 is bonded to the channel plate 2 by adhesive. Further, a hydrophobic layer is formed on a nozzle face (a surface of the nozzle plate 1 from which ink is ejected to the outside, or a surface opposite to the liquid chamber 6 side) of the nozzle plate 1.

In the channel plate 2, opening portions of the individual liquid chambers 6, the liquid supply portions 7, and the liquid inlet portions 8 are formed by, for example, etching a substrate of single-crystal silicon. Alternatively, the channel plate 2 may be formed by etching a metal plate, such as an SUS (stainless steel) plate, with an acid etching solution, or by stamping an SUS plate.

The diaphragm member 3 serves as a wall surface member which forms a wall surface of the individual liquid chambers 6 of the channel plate 2, and includes a deformable diaphragm portion 30 corresponding to each of the individual liquid chambers 6. The diaphragm member 3 may be formed by, for example, electro-formation (electroforming) of a metal plate of Ni or another metal such as stainless, or formed of a resin film of a resin such as polyimide resin, or formed of a laminated member including a metal layer and a resin layer in combination.

The piezoelectric actuator 11 which deforms the diaphragm portion 30 of the diaphragm member 3 is disposed on an outer surface of the diaphragm portion 30 opposite to a surface facing the individual liquid chambers 6. In the piezoelectric actuator 11, a piezoelectric-element member 12 including a plurality of piezoelectric-element pillars 12A is bonded to a base substrate 13 by adhesive. The piezoelectric-element member 12 is fixed onto the base substrate 13, and the piezoelectric-element member 12 is grooved or slit by half cutting dicing to form a required number of piezoelectric-element pillars 12A and 122 in the piezoelectric-element member 12, which are arrayed in a comb-like pattern at intervals of a predetermined distance.

The piezoelectric-element pillars 12A and 12B in the piezoelectric-element member 12 have the same configuration. However, a drive voltage is applied to the piezoelectric-element pillars 12A and these pillars may be referred to as driven pillars 12A. No drive voltage is applied to the piezoelectric-element pillars 12B and these pillars may be referred to as non-driven pillars 12B. As shown in FIG. 3, the driven pillars 12A are bonded to raised portions 30*a* formed in the diaphragm portions 30 of the diaphragm member 3, while the non-driven pillars 12B are bonded to raised portions 30*b* of the diaphragm member 3.

The piezoelectric-element member 12 includes a multilayer piezoelectric element in which piezoelectric layers and internal-electrode layers are alternately laminated. The internal-electrode layers are connected to external electrodes on an end face of the piezoelectric-element member 12, and the external electrodes of the driven pillars 12A in the piezoelectric-element member 12 are connected to a flexible printed circuit (FPC) 15 which transmits drive signals.

The frame member 20 is formed by injection molding using an epoxy resin or thermoplastic resin (e.g., polyphenylenesulfite), and the common liquid chamber 10 to which ink is supplied from a head tank or ink cartridge (not illustrated) is formed in the frame member 20. The common liquid chamber 10 is provided to communicate with the liquid inlet portions 8, the resistance portions 7, and the pressure chambers 6 via the filter portions 9.

In the liquid ejection head described above, for example, when the voltage applied to the piezoelectric-element pillars 12A of the piezoelectric-element member 12 is reduced below a reference potential, the piezoelectric-element pillars 12A contract. Thereby, the diaphragm portion 30 of the diaphragm member 3 is deformed to increase the volume of the corresponding pressure chamber 6, causing ink to flow into the pressure chamber 6. By contrast, when the voltage applied to the piezoelectric-element pillars 12A is increased, the piezoelectric-element pillars 12A extend in the direction in which the piezoelectric-element layers and the internal-electrode layers are laminated. Thereby, the diaphragm portion 30 of the diaphragm member 3 is deformed toward the nozzle 4 to reduce the volume of the pressure chamber 6. Thus, ink in the pressure chamber 6 is subjected to pressure and ejected as ink drops from the nozzle 4. When the voltage applied to the piezoelectric-element pillars 12A is returned to the reference potential, the diaphragm portion 30 of the diaphragm member 3 is returned to the original position. At this time, the volume of the pressure chamber 6 is increased to generate negative pressure, thus causing ink to be supplied from the common liquid chamber 10 to the pressure chamber 6 via the resistance portion 7. After vibration of the meniscus surfaces of the nozzles 4 decays into a stable state, the process proceeds to the following liquid ejection.

In this regard, it is to be noted that the method of driving the liquid ejection head is not limited to the above-described manner (i.e., a so-called pull-push driving method). Alternatively, the method of driving the liquid ejection head may be, for example, a pull driving method or a push driving method.

Next, the diaphragm member 3 and the channel plate 2 in the liquid ejection head according to the first exemplary embodiment will be described with reference to FIGS. 4A to 7.

Figure 4A:
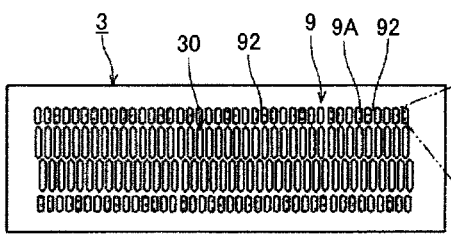
FIG. 4A is a plan view showing a diaphragm member in the liquid ejection head according to the first exemplary embodiment.
Figure 4B:
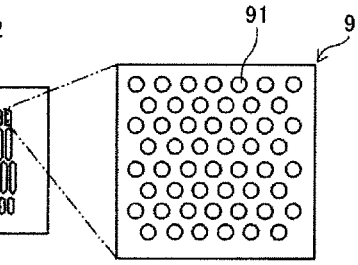
FIG. 4B is an enlarged view showing a principal part of the diaphragm member shown in FIG. 4A.
Figure 5:
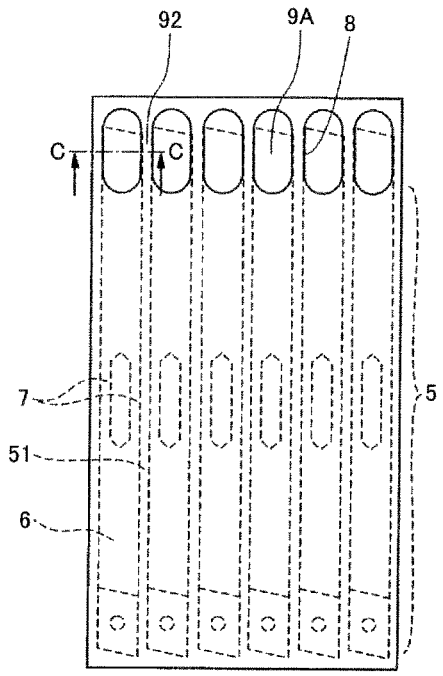
FIG. 5 is a plan view showing a channel plate and the diaphragm member in the liquid ejection head according to the first exemplary embodiment.
Figure 7:
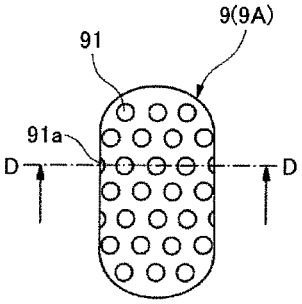
FIG. 7 is an enlarged view showing a filter region of the diaphragm member shown in FIG. 5.

FIG. 4A is a plan view showing the diaphragm member 3 in the liquid ejection head according to the first exemplary embodiment. FIG. 4B is an enlarged view showing a principal part of the diaphragm member 3 shown in FIG. 4A. FIG. 5 is a plan view showing the channel plate and the diaphragm member in the liquid ejection head according to the first exemplary embodiment. FIG. 5 is a cross-sectional view showing a portion of the channel plate 2 and the diaphragm member 3 taken along a C-C line indicated in FIG. 5. FIG. 7 is an enlarged view showing a filter region of the diaphragm member 3 shown in FIG. 5.

As shown in FIGS. 4A and 4B, the filter portions 9 which filter liquid are formed in the diaphragm member 3 between the common liquid chamber 10 and the liquid inlet portion 8 and a plurality of filter holes 91 to pass through liquid is formed in each of the filter portions 9 of the diaphragm member 3.

In this exemplary embodiment, as shown in FIG. 5, partition walls 51 are formed in a surface of the channel plate 2 on the liquid inlet portion 8 side to longitudinally extend between the individual channels 5 and lead to the liquid inlet portions 8 corresponding to the individual channels 5. Alternatively, the partition walls 51 of the channel plate 2 may be arranged so that one liquid inlet portion 8 communicates with two or more individual channels 5, or one liquid inlet portion 8 communicates with all the individual channels 5.

Figure 6:
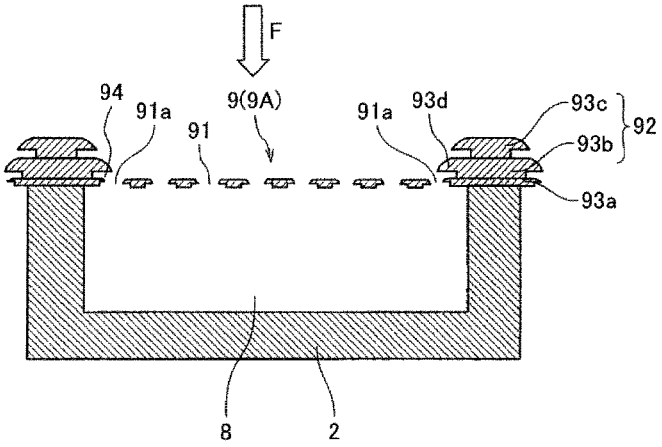
FIG. 6 is a cross-sectional view showing a portion of the channel plate and the diaphragm member taken along a C-C line indicated in FIG. 5.

On the other hand, as shown in FIG. 6, reinforcement parts 92 are formed on a surface of the channel plate 2 on the filter portion 9 side to face the partition walls 51 on the liquid inlet portion 8 side. The reinforcement parts 92 serve as reinforcement portions for the filter portions 9 and longitudinally extend between the filter regions 9A corresponding to the individual channels 5. Alternatively, each of the reinforcement parts 92 may be formed for two or more individual channels 5 and the filter portions 9 may be divided into two or more filter regions 9A so that one filter region 9A corresponds to the two or more individual channels 5.

It is to be noted that a width of each reinforcement wall 92 in the nozzle array direction is greater than a width of the partition wall 51 between the individual channels 5 in the nozzle array direction.

As described above, the diaphragm member 3 to form the filter portions 9 may be formed by electroforming of a nickel plate so that the filter portions 9 have a multiple-layer structure. As shown in FIG. 6, the filter portions 9 include a first layer 93*a* which is the same as the first layer of the diaphragm member 3. The reinforcement parts 92 include a second layer 93*b* and a third layer 93*c* which are the same as the second layer and the third layer of the diaphragm member 3, respectively.

The reinforcement parts 92 formed with the filter portions 9 are needed because of the following reason. The filter portions 9 in this exemplary embodiment have a single-layer structure which is thin. If the filter portions 9 are formed to extend throughout the region where the individual channels 5 are formed, the structural strength of the filter portions 9 becomes low and the filter portions 9 become vulnerable to damage. To avoid the problem, the rigidity of the filter portions 9 is reinforced by disposing the reinforcement parts 92 having a multiple-layer structure at intervals of a predetermined distance in the nozzle array direction. Further, the presence of the reinforcement parts 92 enables the diaphragm member 3 to be adequately pressed at the time of bonding the diaphragm member 3 to the channel plate 2. Hence, it is also possible to increase the bonding rigidity.

In this case, as a result of the electroforming of the diaphragm member 3, overhang portions 93*d* are produced which project from the second layer 93*b* (which forms a part of the reinforcement parts 92) toward the filter region 9A side.

As shown in FIG. 6, the second layer 93*b* as the part of the reinforcement part 92 faces the filter portion 9 (the first layer 93*a*) with a gap 94 between the first and second layers 93*a* and 93*b*, and the overhang portion 93*d* faces some of the filter holes 91 in the liquid flow direction (i.e., the direction indicated by the arrow F in FIG. 6). Hence, the overhang portion 93*d* has an overlap between the second layer 93*b* and the filter region 9A. In other words, the second layer 93*b* which forms the reinforcement parts 92 of the filter portions 9 projects toward the filter regions 9A.

Thereby, as shown in FIG. 7, the filter portions 9 are arranged so that an area of projection of some individual filter holes 91*a* of the filter holes 91 perpendicular to the surface of the channel plate 2 (which surface is perpendicular to the liquid flow direction F indicated in FIG. 6) is smaller than an area of projection of other individual filter holes 91 perpendicular to the surface of the channel plate 2. In other words, in this exemplary embodiment, the filter holes 91 are formed to reach the vicinity of the partition walls 51 of the individual channels 5.

The first layer 93*a* in which the filter holes 91 are formed is formed by electroforming to have a thickness of approximately 3 μm. In order to reinforce this thin layer, the second layer 93*b* and the third layer 93*c* are disposed so that the filter regions 9A of the filter portions 9 are partitioned. Further, in order to make the region in which the filter holes 91 are formed wider than the region in which the second and third layers 93*b* and 93*c* are formed, the filter holes 91 are formed to reach the vicinity of the partition walls 51 beyond the overhang portions 93*d* of the second layer 93*b*.

Accordingly, in the liquid ejection head according to the first exemplary embodiment, the filter-hole arrangement region is increased and the occurrence of stagnation of bubbles is reduced. When suction and pressurizing operations are performed on the liquid ejection head, the ink flow velocity at downstream positions of the filter portions 9 is increased and the liquid ejection head may easily discharge bubbles there.

Next, a comparative example will be described with reference to FIGS. 8 and 9.

Figure 8:
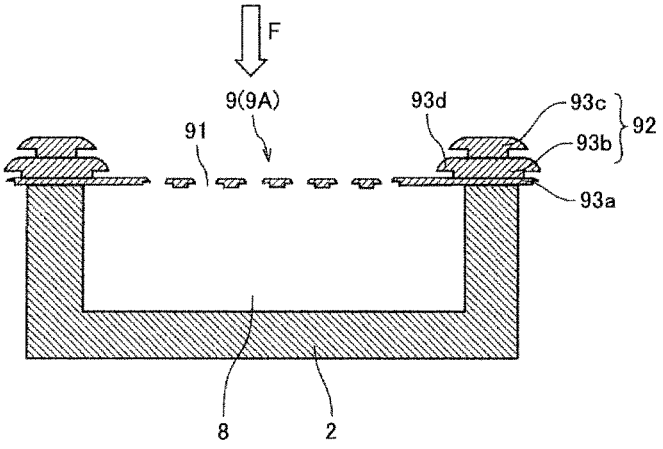
FIG. 8 is a cross-sectional view showing a portion of a channel plate and a diaphragm member of a comparative example taken along the C-C line indicated in FIG. 5.

FIG. 8 is a cross-sectional view showing a portion of a channel plate and a diaphragm member of the comparative example taken along the C-C line indicated in FIG. 5. FIG. 9 is an enlarged view showing a filter region of the diaphragm member of the comparative example shown in FIG. 8. The cross-sectional view in FIG. 8 is equivalent to a cross-sectional view of the channel plate taken along an E-E line indicated in FIG. 9.

Figure 9:
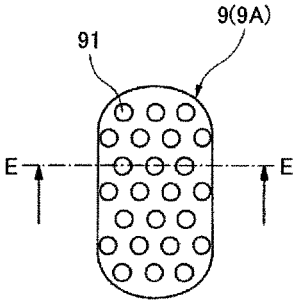
FIG. 9 is an enlarged view showing a filter region of the diaphragm member of the comparative example shown in FIG. 8.

As shown in FIGS. 8 and 9, in this comparative example, the channel plate is not arranged to form the filter holes 91 to reach the vicinity of the partition walls 51 of the individual channels 5 beyond the overlap portions 93*b* of the second layer 93*b* in the liquid flow direction as in the first exemplary embodiment.

Figure 10A:
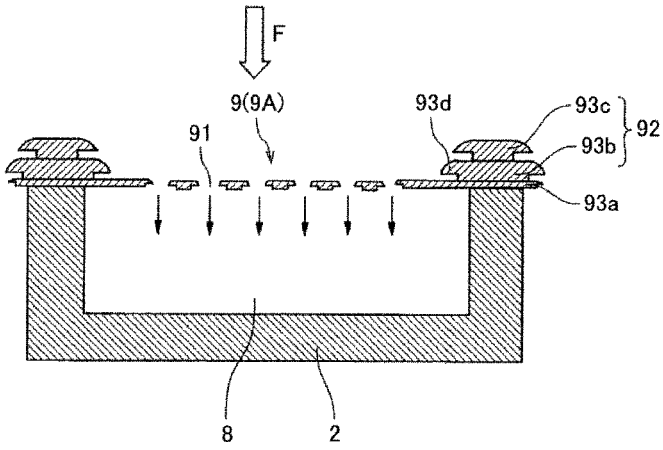
FIGS. 10A and 10B are diagrams for explaining a difference in flow velocity between the comparative example and the first exemplary embodiment.
Figure 10B:
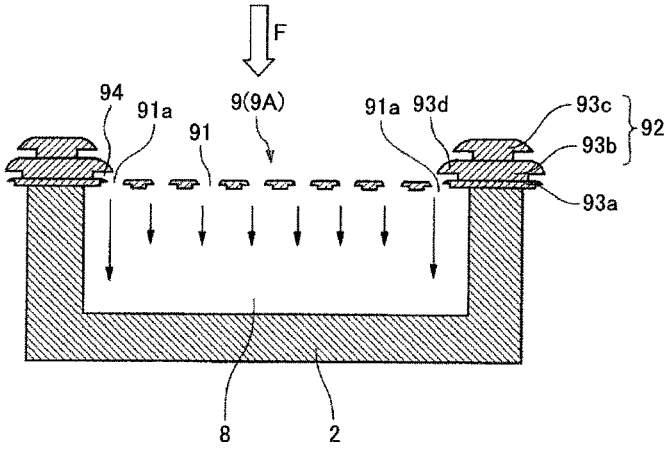

FIGS. 10A and 10B are diagrams for explaining a difference in flow velocity between the comparative example and the first exemplary embodiment.

As shown in FIG. 10A, in the composition of the comparative example, the flow velocity of ink immediately after the ink has passed through the filter holes 91 is almost the same at any position of the filter holes 91. In FIGS. 10A and 10B, the arrow F represents the liquid flow direction, the small arrow represents the ink flow velocity, and the length of the small arrow represents the magnitude of the ink flow velocity. The greater the length of the arrow, the greater the ink flow velocity.

Therefore, if a width of each of the partition walls 51 on the side of the liquid inlet portions 8 is less than a width of each of the reinforcement parts 92, stagnation of liquid may arise on the liquid inlet portion 8 side. There is a possibility that bubbles stagnate there.

In contrast, as shown in FIG. 10B, in this exemplary embodiment, the channel plate 2 is arranged to form the filter holes 91 to reach the vicinity of the partition walls 51 of the individual channels 5 beyond the overlap portions 93*d* of the second layer 93*b* in the liquid flow direction. The filter holes 91*a* located in the position where the filter holes 91*a* overlap the second layer 93*b* in which the reinforcement parts 92 are formed have a reduced area of projection when viewed from the liquid flow direction which is smaller than that of other filter holes 91. Hence, the ink flow velocity at the filter holes 91*a* is increased to be slightly greater than the ink flow velocity at other filter holes 91.

If the width of each of the partition walls 51 on the side of the liquid inlet portions 8 is less than the width of each of the reinforcement parts 92, the ink flow velocity at the downstream positions of the filter portions 9 is decreased and bubbles there may stagnate. However, in the first exemplary embodiment, the reinforcement parts 92 projecting to the filter portions 9 overlap the filter holes 92*a* located on the partition wall 51 side of the filter portions 9, so that the area of projection of each of the filter holes 92*a* is reduced, and the ink flow velocity at the downstream positions of the filter portions 9 is increased. Accordingly, the occurrence of stagnation of bubbles on the liquid inlet portion 8 side is prevented and the liquid ejection head according to the first exemplary embodiment may easily discharge bubbles because of the increased ink flow velocity.

Figure 11:
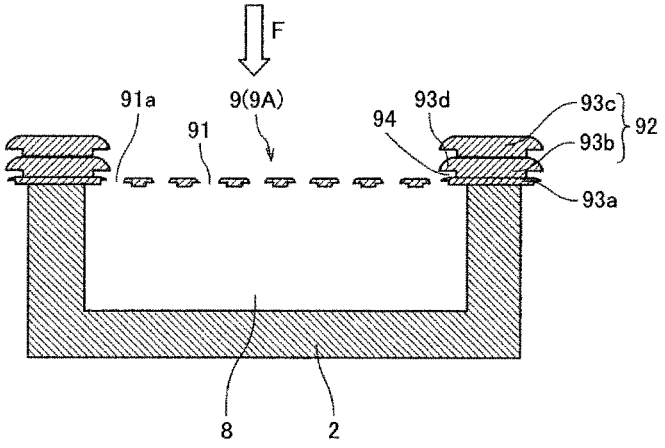
FIG. 11 is a cross-sectional view showing a portion of a channel plate and a diaphragm member according to a second exemplary embodiment taken along the C-C line indicated in FIG. 5.

Next, a liquid ejection head according to a second exemplary embodiment will be described with reference to FIG. 11. FIG. 11 is a cross-sectional view showing a channel plate and a diaphragm member according to the second exemplary embodiment taken along the C-C line indicated in FIG. 5. In FIG. 11, the elements which are essentially the same as corresponding elements in FIG. 6 are designated by the same reference numerals, and a description thereof will be omitted.

As shown in FIG. 11, in the second exemplary embodiment, the diaphragm member 3 includes the filter portions 9 which are formed by the first layer 93*a*, and the reinforcement parts 92 which are formed by the second layer 93*b* and the third layer 93*c*. The third layer 93*c* which forms a part of the reinforcement parts 92 is configured so that a width of the third layer 93*c* in the nozzle array direction is the same as a width of the second layer 93*b* in the nozzle array direction.

In the case of the liquid ejection head according to the second exemplary embodiment, the advantageous features of the liquid ejection head according to the first exemplary embodiment can be obtained.

Next, an image forming device according to an exemplary embodiment which uses the liquid ejection head according to the first or second exemplary embodiment will be described with reference to FIG. 12 and FIG. 13.

Figure 12:
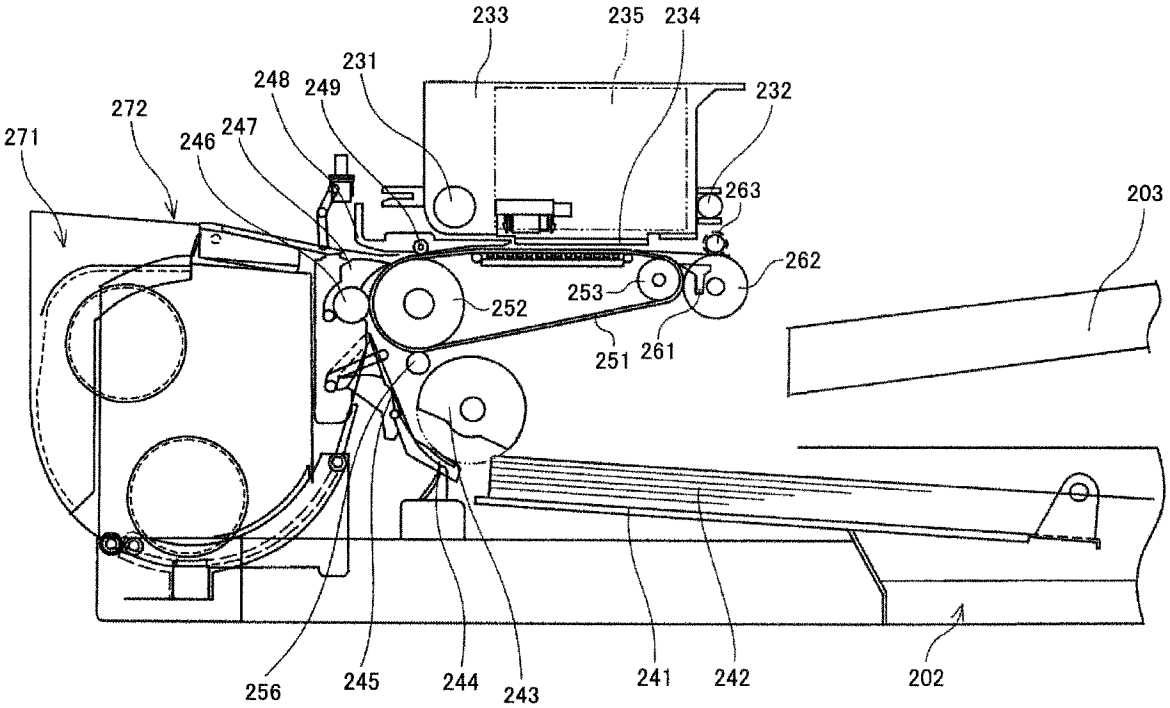
FIG. 12 is a schematic view showing a mechanical part of an image forming device according to an exemplary embodiment.

FIG. 12 is a schematic view showing a mechanical part of the image forming device according to this exemplary embodiment. FIG. 13 is a partial plan view showing the mechanical part of the image forming device.

Figure 13:
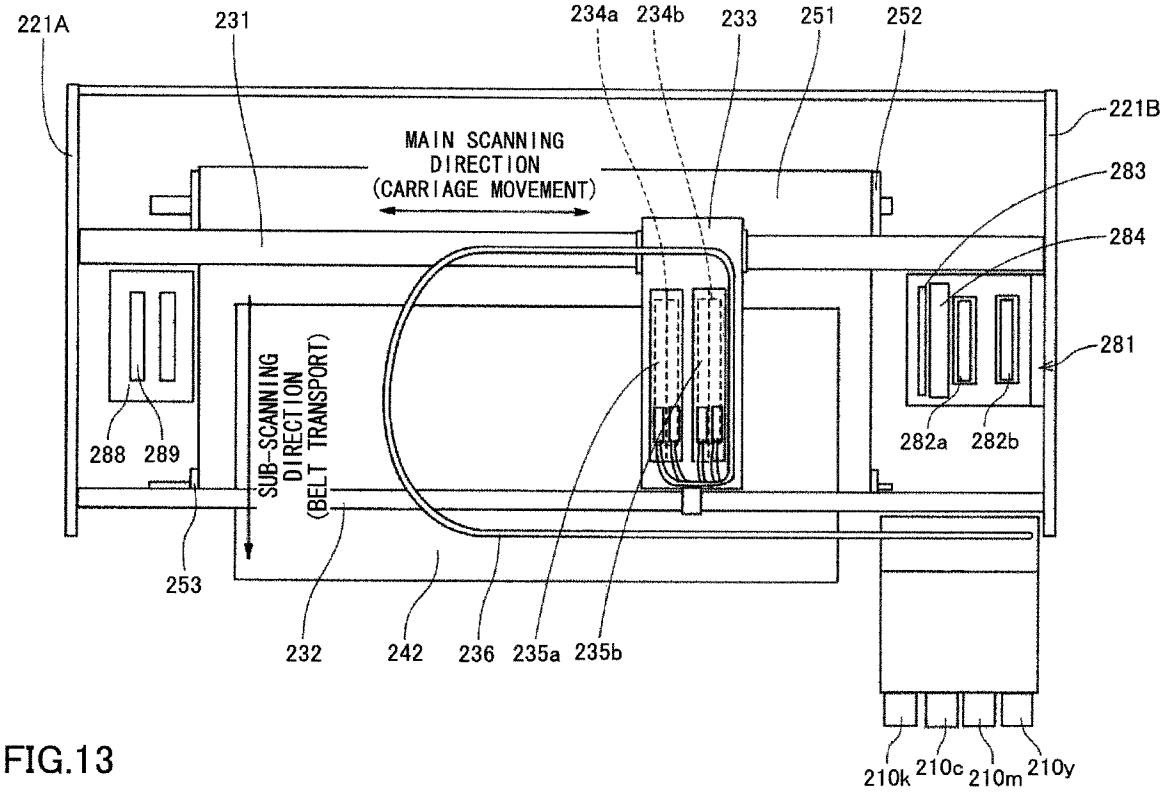
FIG. 13 is a partial plan view showing the mechanical part of the image forming device.

In FIGS. 12 and 13, the image forming device is illustrated as a serial type image forming device. In the image forming device, a main guide rod 231 and a sub guide rod 232 extend between side plates 221A and 221B to support a carriage 233 which is movable in a main scanning direction indicated by the arrow in FIG. 13. The carriage 233 is moved for scanning by a main scan motor (not illustrated) via a timing belt.

A recording head assembly 234 includes a plurality of liquid-ejection head units. Each liquid-ejection head unit is formed as a single unit with a liquid ejection head according to an exemplary embodiment of the present disclosure to eject ink drops of the corresponding color, e.g., yellow (Y), cyan (C), magenta (M), or black (K), an electric circuit board (not illustrated) to transmit drive signals to the liquid ejection head, and a tank 235 that stores ink supplied to the liquid ejection head. The recording head assembly 234 is mounted on the carriage 233 so that a plurality of rows of nozzles is arranged in a sub-scanning direction indicated by the arrow in FIG. 13, which is perpendicular to the main scanning direction, so as to eject ink drops downward.

The recording head assembly 234 includes liquid-ejection head units 234*a* and 234*b* mounted on a base member. Each of the liquid-ejection head units 234*a* and 234*b* may include, e.g., two nozzle rows. For example, the liquid-ejection head unit 234*a* may eject black ink drops from one nozzle row and eject cyan ink drops from the other nozzle row, and the liquid-ejection head unit 234*b* may eject magenta ink drops from one nozzle row and eject yellow ink drops from the other nozzle row. In this exemplary embodiment, the recording head assembly 234 includes two liquid-ejection head units that eject ink drops of four colors. However, it is to be noted that the head configuration is not limited to such configuration and for example, four nozzle rows may be formed in a single head to eject ink drops of four different colors.

Respective color inks are supplied from corresponding ink cartridges 210 through corresponding supply tubes 236 to replenish the tanks 235 of the recording-head assembly 234.

The image forming device further includes a sheet feeding unit which feeds sheets 242 stacked on a sheet stack portion (platen) 241 of a sheet feed tray 202. The sheet feeding unit includes a sheet feed roller 243 which separates the sheets 242 from the sheet stack portion 241 and feeds the sheets 242 sheet by sheet, and a separating pad 244 which is disposed to face the sheet feed roller 243. The separating pad 244 is made of a material of a high friction coefficient and biased toward the sheet feed roller 243.

To feed the sheet 242 from the sheet feeding unit to a portion below the recording head assembly 234, the image forming device includes a first guide member 245 which guides the sheet 242, a counter roller 246, a conveyance guide member 247, a press member 248 including a front-end press roller 249, and a transport belt 251 which transports the sheet 242 to a position facing the recording head assembly 234 with the sheet 242 electrostatically attracted thereon.

The transport belt 251 is an endless belt which is looped between a transport roller 252 and a tension roller 253 so as to circulate in a belt transport direction (which is the sub-scanning direction indicated by the arrow in FIG. 13). A charge roller 256 is provided to charge the surface of the transport belt 251. The charge roller 256 is disposed to contact the surface of the transport belt 251 and rotate depending on the circulation of the transport belt 251. By rotating the transport roller 252 by a sub-scan motor (not illustrated) via a timing roller, the transport belt 251 circulates in the belt transport direction.

The image forming device further includes a sheet output unit which outputs the sheet 242 on which an image has been formed by the recording head assembly 234. The sheet output unit includes a separating claw 261, a first output roller 262, a second output roller 263, and the sheet output tray 203 disposed below the first output roller 262. The separating claw 261 is provided to separate the sheet 242 from the transport belt 251.

A duplex unit 271 is removably mounted on a rear portion of the image forming device. When the transport belt 251 rotates in reverse to return the sheet 242, the duplex unit 271 receives the sheet 242 and turns the sheet 242 upside down to feed the sheet 242 between the counter roller 246 and the transport belt 251 again. A top face of the duplex unit 271 is formed into a manual feed tray 272.

Further, as shown in FIG. 13, a maintenance unit 281 is disposed at a non-print area on one end in the main scanning direction of the carriage 233. The maintenance unit 281 including a recovery device maintains and recovers the nozzles of the recording head assembly 234. The maintenance unit 281 includes cap members 282*a* and 282*b* (hereinafter collectively referred to as "caps 282" unless distinguished) which cover the nozzle faces of the recording head assembly 234, a wiper blade 283 which is a blade member to wipe the nozzle faces of the recording head assembly 234, and a first drop receiver 284 which receives ink drops when maintenance ejection is performed to discharge increased-viscosity ink.

Further, as shown in FIG. 13, a second drop receiver 288 is disposed at a non-print area on the other end in the main scanning direction of the carriage 233. The second drop receiver 288 receives ink drops which are ejected to discharge increased-viscosity ink in recording operations (image forming operations) and so on. The second drop receiver 288 includes openings 289 arranged in parallel with the rows of the nozzles of the recording head assembly 234.

In the image forming device having the above-described configuration, the sheets 242 are separated sheet by sheet from the sheet feed tray 202, fed in a substantially vertically upward direction, guided along the first guide member 245, and transported while sandwiched between the transport belt 251 and the counter roller 246. Further, the front tip of the sheet 242 is guided with the conveyance guide member 247 and pressed with the front-end press roller 249 against the transport belt 251 so that the transport direction of the sheet 242 is turned substantially 90 degrees.

At this time, positive and negative voltages are alternately applied to the charge roller 256 so that the transport belt 251 is charged with an alternating voltage pattern, that is, an alternating band pattern of positively-charged areas and negatively-charged areas in the sub-scanning direction, i.e., the belt transport direction. When the sheet 242 is fed onto the transport belt 251 alternately charged with positive and negative charges, the sheet 242 is electrostatically attracted on the transport belt 251 and transported in the sub-scanning direction by circulation of the transport belt 251.

By driving the recording head assembly 234 in response to image signals while moving the carriage 233, ink drops are ejected on the sheet 242 stopped below the recording head assembly 234 to form one line of a desired image. Then, the sheet 242 is fed by a certain amount to prepare for recording another line of the image. By receiving a signal indicating that the image has been recorded or the rear end of the sheet 242 has arrived at the recording area, the recording head assembly 234 finishes the recording operation and outputs the sheet 242 to the sheet output tray 203.

As described in the foregoing, the liquid ejection head according to an exemplary embodiment of the present disclosure may overcome the difficulty of discharging bubbles. Further, as described above, the image forming device includes the liquid ejection head according to an exemplary embodiment of the present disclosure as a recording head and may provide a high quality image in a stable manner.

In the present disclosure, the term "sheet" is not limited to a sheet of paper and includes anything such as an OHP (overhead projector) sheet or a cloth sheet to which ink or liquid drops are attached. In other words, the term "sheet" is used as a generic term including a recording medium, a recorded medium, or a recording sheet.

In the present disclosure, the term "image forming device" refers to a device that ejects ink or any other liquid onto a medium to form an image on the medium. The medium is made of, for example, paper, yarn, fiber, textile, leather, metal, plastic, glass, wood, and ceramic. The term "image formation" used herein includes providing not only meaningful images such as characters and figures, but meaningless images such as patterns to the medium. The term "ink" used herein is not limited to "ink" in a narrow sense and includes anything usable for image formation, such as a DNA sample, resist, pattern material, resin, washing fluid, storing solution, and fixing solution. The term "image" used herein is not limited to a two-dimensional image and includes a three-dimensional image, and an image modeled to be a three-dimensional object.

Unless otherwise specified, the image forming device according to the present disclosure includes a serial type image forming device and a line-head type image forming device.

The liquid ejection head according to the present disclosure is not limited to the above-described exemplary embodiments, and variations and modifications may be made without departing from the scope of the present disclosure.

The present application is based upon and claims the benefit of priority of Japanese Patent Application No. 2013-021841, filed on Feb. 6, 2013, the contents of which are incorporated herein by reference in their entirety.

What is claimed is:

1. A liquid ejection head comprising:

a plurality of nozzles to eject liquid drops;

a plurality of individual liquid chambers communicating with the plurality of nozzles;

a plurality of liquid inlet portions leading to the plurality of individual liquid chambers;

a common liquid chamber to supply liquid to the plurality of individual liquid chambers;

a plurality of filter portions disposed between the common liquid chamber and the liquid inlet portions, each of the plurality of filter portions including filter holes and filtering the liquid; and a plurality of reinforcement parts formed with the plurality of filter portions to partition the plurality of filter portions, each of the plurality of reinforcement parts including a part facing some of the filter holes of a corresponding one of the plurality of filter portions in a liquid flow direction, with a gap between the filter holes and the reinforcement part, and the plurality of reinforcement parts being disposed on a common liquid chamber side of the plurality of filter portions to have a multiple layer structure at intervals of a predetermined distance in a nozzle array direction of the plurality of nozzles.

2. The liquid ejection head according to claim 1, wherein each of the plurality of reinforcement parts has the multiple layer structure.

3. The liquid ejection head according to claim 1, wherein the plurality of reinforcement parts is provided to face the plurality of individual liquid chambers and a width of each of the plurality of reinforcement parts in the nozzle array direction is greater than a width of each of partitions between the individual liquid chambers in the nozzle array direction.

4. The liquid ejection head according to claim 1, wherein the plurality of filter portions is arranged in a diaphragm member which forms a wall surface of the individual liquid chambers.

5. The liquid ejection head according to claim 1, wherein in the multiple layer structure of each reinforcement part amongst the reinforcement parts, one layer of the reinforcement part is disposed on another layer of the reinforcement part.

6. An image forming device including a liquid ejection head, the liquid ejection head comprising:

a plurality of nozzles to eject liquid drops;

a plurality of individual liquid chambers communicating with the plurality of nozzles;

a plurality of liquid inlet portions leading to the plurality of individual liquid chambers;

a common liquid chamber to supply liquid to the plurality of individual liquid chambers;

a plurality of filter portions disposed between the common liquid chamber and the liquid inlet portions, each of the plurality of filter portions including filter holes and filtering the liquid; and a plurality of reinforcement parts formed with the plurality of filter portions to partition the plurality of filter portions, each of the plurality of reinforcement parts including a part facing some of the filter holes of a corresponding one of the plurality of filter portions in a liquid flow direction, with a gap between the filter holes and the reinforcement part, and the plurality of reinforcement parts being disposed on a common liquid chamber side of the plurality of filter portions to have a multiple layer structure at intervals of a predetermined distance in a nozzle array direction of the plurality of nozzles.

* * * * *